US006886218B2

(12) United States Patent
ter Braak

(10) Patent No.: US 6,886,218 B2
(45) Date of Patent: May 3, 2005

(54) APPARATUS FOR MOVING A CURTAIN ALONG A CURTAIN RAIL

(75) Inventor: Bart ter Braak, Doorn (NL)

(73) Assignee: Rolf Edward Goelst, Ede (NL)

( * ) Notice: Subject to any disclaimer, the term of this patent is extended or adjusted under 35 U.S.C. 154(b) by 0 days.

(21) Appl. No.: 10/401,382

(22) Filed: Mar. 27, 2003

(65) Prior Publication Data

US 2003/0221282 A1 Dec. 4, 2003

(30) Foreign Application Priority Data

Mar. 28, 2002 (NL) ..... 1020272

(51) Int. Cl.[7] ..... A47H 13/00
(52) U.S. Cl. ..... 16/87 R; 16/87.4 R; 16/93 R
(58) Field of Search ..... 16/87 R, 93 D, 16/87.2, 87.4 R, 93 R; 160/330–332, 344, 124, 345–347

(56) References Cited

U.S. PATENT DOCUMENTS

| | | | | | |
|---|---|---|---|---|---|
| 3,626,429 | A | * | 12/1971 | Toder | 16/87.2 |
| 3,753,457 | A | * | 8/1973 | Bratschi | 160/331 |
| 4,102,381 | A | * | 7/1978 | Bratschi | 160/168.1 R |
| 4,492,262 | A | * | 1/1985 | Comeau | 160/126 |
| 4,495,671 | A | * | 1/1985 | Comeau et al. | 16/87 R |
| 4,525,893 | A | * | 7/1985 | Fukada | 16/102 |
| 4,683,935 | A | | 8/1987 | Arquati | |
| 4,964,191 | A | * | 10/1990 | Wyatt | 16/87.2 |
| 5,249,617 | A | * | 10/1993 | Durig | 160/168.1 R |
| 5,518,058 | A | * | 5/1996 | Gastmann | 160/330 |
| 6,098,246 | A | * | 8/2000 | Moir | 16/87.2 |

FOREIGN PATENT DOCUMENTS

| | | | | |
|---|---|---|---|---|
| CH | 597811 A | * | 4/1978 | A47H/1/104 |
| DE | 3410056 A1 | * | 9/1985 | A47H/1/04 |
| EP | 0 782 833 A1 | | 7/1997 | |
| EP | 1 316 281 A1 | | 4/2003 | |
| GB | 2169189 A | * | 7/1986 | A47H/5/02 |
| JP | 03280907 A | * | 12/1991 | A47H/5/02 |
| JP | 10033360 A | * | 2/1998 | A47H/13/10 |
| JP | 10337246 A | * | 12/1998 | A47H/13/04 |

* cited by examiner

*Primary Examiner*—Chuck Y. Mah
(74) *Attorney, Agent, or Firm*—Merchant & Gould P.C.

(57) ABSTRACT

An apparatus for moving a curtain along a curtain rail, which apparatus is provided with driving means (5, 6; 105, 106) movable along the curtain rail (1) and, in use, coupling means (10; 110) connected to the curtain, which coupling means (10, 11; 110, 111) are arranged to couple the curtain to the driving means (5, 6; 105, 106), wherein the apparatus is provided with operable uncoupling means (14; 114) which are arranged to uncouple, at least during operation, the coupling means (10, 11; 110, 111) from the driving means (5, 6; 105, 106), so that the curtain is movable along the curtain rail (1) independently of the driving means, the uncoupling means (14; 114) being arranged to be operated independently of a force (10, 11) exerted on the curtain in a curtain rail longitudinal direction.

13 Claims, 4 Drawing Sheets

APPARATUS FOR MOVING A CURTAIN ALONG A CURTAIN RAIL

The invention relates to an apparatus for moving a curtain along a curtain rail, which apparatus is provided with driving means movable along the curtain rail and, in use, coupling means connected to the curtain, which coupling means are arranged to couple the curtain to the driving means.

Such an apparatus is known from European patent application EP 0 782 833. With this apparatus, a curtain can be closed and opened automatically. The curtain is coupled to the driving means, while the driving means are driven by a drive, such as an electric motor. The curtain can be uncoupled from the driving means, so that it can be opened and closed by hand. Thus, the curtain can be operated by hand, also when the driving means are blocked by a coupled drive during power failure. To this end, the coupling means of the known apparatus comprise a coupling element provided with a movable locking pin having a beveled end. When the coupling element is coupled to the driving element, this beveled end extends into a hollow space of a driving element of the driving means. By means of a spring it is ensured that the locking pin cannot by itself move out of the hollow space. Uncoupling is effected by exerting on the curtain a force directed in the curtain rail longitudinal direction. This creates an interplay of forces between the beveled end of the locking pin and a wall of the hollow space of the driving element, as a result of which an uncoupling force acting against a spring force of the above spring is created on the locking pin. When this uncoupling force is sufficiently great, at least greater than the spring force and a frictional force exerted on the end of the locking pin by the wall of the hollow space, the locking pit slides out of the hollow space so that the coupling between the driving means and the curtain is undone.

A drawback of the known apparatus is that the coupling means are unreliable in use. In fact, when the driving means start or stop abruptly, an undesired uncoupling of the curtain can be effected if the curtain undergoes such acceleration or deceleration that the uncoupling force is reached. Furthermore, the hollow space and the locking pin are susceptible to wear, which may result in, for instance, a change in the bevel and/or length of the end of the locking pin. This also has an adverse effect on the reliability of the coupling between the curtain and the driving means, because such wear affects the force required to slide the locking pin out of the hollow space. Also, the locking pin-hollow space coupling is susceptible to soiling, such as dirt, rail grindings or the like, which may prevent or at least adversely affect a desired uncoupling of the curtain, for instance through an increase of friction between the end of the locking pin and the wall of the hollow space.

An additional drawback of the known apparatus is that the bevel of the end of the locking pin and the strength of the spring must be accurately adjusted to each other, so that a desired uncoupling is reached only at a specific force exerted on the curtain. This force must not be so low that undesired uncouplings can take place. Also, the force must not be so high that just no uncoupling of the curtain can be effected, which relatively great force can lead to damage to the curtain, the driving means and/or the drive. This drawback may cause, for instance, situations dangerous to life, for instance in case of fire, in which panic can break out when users cannot easily open a closed curtain. This particularly applies to relatively weak users, such as children, or weakened users stupefied by smoke.

Furthermore, it is a drawback of the known apparatus that the bevel of the end of the locking pin and the strength of the spring can only be adjusted to a curtain of one specific curtain mass to be moved along the curtain rail by the driving means. Therefore, when replacing the curtain by a curtain having another mass, the apparatus must be adapted, adjusted or even be replaced by another apparatus to be able to secure the reliability of the coupling and uncoupling of the curtain respectively to and from the driving means. Furthermore, automatically picking up a once uncoupled leader is difficult in the known apparatus in connection with the rather strong spring required for the proper operation of the apparatus.

The present invention has for its object to remove the above drawbacks of the apparatus while retaining the advantages thereof. That is to say an apparatus in which the curtain can be closed and opened by using driving means or by hand, both the coupling and a manual uncoupling of the curtain respectively to and from the driving means being very reliable.

To this end, the invention provides an apparatus of the type described in the opening paragraph, characterized in that the apparatus is provided with operable uncoupling means which are arranged to uncouple, at least during operation, the coupling means from the driving means, so that the curtain is movable along the curtain rail independently of the driving means, the uncoupling means being arranged to be operated independently of a force exerted on the curtain in a curtain rail longitudinal direction.

In this manner, the curtain can be uncoupled manually from the driving means by operating the uncoupling means, so that the curtain can then be opened and closed by hand. The coupling between the driving means and the curtain may be designed so as to be very reliable, so that undesired uncoupling is prevented. Because the uncoupling means are arranged to be operated independently of a force exerted on the curtain in a curtain rail longitudinal direction, this further prevents the possibility of uncoupling taking place through a relatively great acceleration or deceleration of the curtain as a result of, for instance, an activation or deactivation of the driving means. An additional advantage is that the coupling and uncoupling means can be designed independently of each other, such that they are very insusceptible to wear and/or soiling, which enhances the reliability of both the coupling between the curtain and the driving means and a manual uncoupling of the curtain. Also, with such an apparatus it is possible, after uncoupling of the driving means and the coupling means connected with the curtain, to automatically effect again a coupling between the coupling means and the driving means by moving the driving means along the coupling means again.

Another advantage is that a relatively accurate adjustment of the coupling means is no longer necessary to be able to secure a reliable coupling and uncoupling. Therefore, the coupling means may be arranged to couple curtains of different masses to driving means. The adjustment of the uncoupling means with respect to an uncoupling force required for uncoupling can occur independently of the adjustment of the coupling means and, therefore, can be carried out in a relatively simple manner.

Preferably, the uncoupling means are connected with the curtain, such that the uncoupling means are operated when a force directed downward, substantially perpendicularly to the curtain rail longitudinal direction, is exerted on the curtain, a pulling cord or pulling stick.

The user can easily open or close the curtain manually by directly pulling it substantially in downward direction.

Besides, the operation of the uncoupling means can be easily effected. Furthermore, the uncoupling means thus need not be provided with an operating means, such as a cord or stick, which can complicate the operation of the uncoupling means.

In a preferred embodiments of the invention, the driving means are provided with a driving body, the coupling means comprising a coupling body with an engaging element, which engaging element, in a first position, couples the coupling body to the driving body, the engaging element moving from the first to a second position when operating the uncoupling means.

This is a practical embodiment of the invention, Preferably, the engaging element, in the first position, engages the driving body such that the driving body exerts on the engaging element a force directed substantially in the curtain rail longitudinal direction when a force is exerted on the curtain substantially in a curtain rail longitudinal direction. Thus, a relatively strong coupling between the curtain and the driving body can be effected. The driving body and the coupling body may be movably disposed along respectively a first and a second rail part, so that a proper, unhindered guidance of each of these bodies can be obtained.

According to a further elaboration, the uncoupling means are provided with spring means which exert a spring force on the engaging element, which spring force is directed from the second to the first position of the engaging element.

The spring means ensure that the engaging element does not move by itself, for instance under the action of gravity, to the second position, which prevents an undesired uncoupling of the coupling body. Also, the spring means may be of such design that they can keep the engaging element even in the first position after a specific decrease of the strength of the spring means as a result of frequent use, so that undesired uncoupling of the curtain is avoided.

According to an advantageous elaboration, the driving body is provided with coupling means for coupling an uncoupled coupling body moved away from the driving body, which coupling means, in use, exert a coupling force on the engaging element when the driving body and the coupling body are moved along each other, which coupling force is directed against the spring force of the spring means.

The coupling means ensure that an uncoupled coupling body can be coupled to the driving body again. The coupling means move the engaging element to the second position, so that the driving body can move along the coupling body. When the driving body is in a coupling position beside the coupling body, the coupling means can release the engaging element, so that the spring means can move the engaging element to the first position. As a result, the coupling body and the driving body are coupled together again.

According to a further elaboration of the preferred embodiment, the engaging element comprises a locking pin which, in the first position, extends from the coupling body into an opposite hollow space of the driving body, which locking pin, in the second position, is outside the driving body, such that the coupling body is uncoupled from the driving body.

The locking pin is a simple embodiment of the engaging element. The coupling which the locking pin effects between the coupling body and the driving body is relatively strong.

Preferably, the locking pin extends substantially at right angles to the longitudinal direction of the curtain rail, the coupling means comprising a click section, which click section, in use, drops the locking pin into the hollow space when the coupling body and the driving body are moved along each other from a position moved away from each other.

The click section is an inexpensive simple embodiment of the coupling means. The section pushes the locking pin in the direction of the second position when the coupling body and the driving body move along each other, until the locking pin is opposite the hollow space. At that moment, the locking pin does not touch the section and can shoot into the hollow space, so that the coupling is realized.

According to an advantageous elaboration of the preferred embodiment, the uncoupling means comprise a pivoting arm which is pivotally connected with the coupling body, the pivoting arm (a part thereof located between the ends) being coupled to the engaging element such that, in use, the engaging element moves from the first to the second position when the pivoting arm moves from a first to a second pivoting position.

A user can simply move the engaging element to the second position by means of the pivoting arm. Because the coupling body with the pivoting arm is generally located at an unreachable height near the curtain rail, it may be provided with, for instance, an operating member, such as a cord or a pulling stick, to enable operation. Also, the pivoting arm may be connected with the curtain, such that the pivoting arm moves to the second pivoting position when a force directed substantially perpendicularly to the curtain opening direction is exerted on the curtain.

According to an extra advantageous elaboration, the uncoupling means are provided with pivoting arm spring means which exert a spring force on the pivoting arm, which spring force is directed from the second to the first pivoting position of the pivoting arm.

The pivoting arm spring means prevent the pivoting arm from moving by itself to the second pivoting position in which the pivoting arm takes along the engaging element to the second position. Moreover, the pivoting arm spring means can carry a part of the weight of a curtain attached to the pivoting arm. Thus, a user can operate the pivoting arm by pulling down that part of the curtain.

Preferably, the pivoting arm is coupled to the engaging element with such play that the engaging element is movable from the first to the second position when the pivoting arm is in the first pivoting position.

After the coupling body has been uncoupled from the driving body, it is often desirable to couple both bodies together later again. The engaging element must then be moved from the first to the second position, for instance by the above coupling means, if it is in the first position. This movement of the engaging element is facilitated by the above play with which the pivoting arm is coupled to the engaging element. Thus, the movement of the engaging element is not hindered by the pivoting arm which is in the first pivoting position, nor by the optional pivoting arm spring means which keep the pivoting arm in the first pivoting position.

The invention will hereinafter be explained in more detail on the basis of an exemplary embodiment, with reference to the drawing in which.

Figure 2:
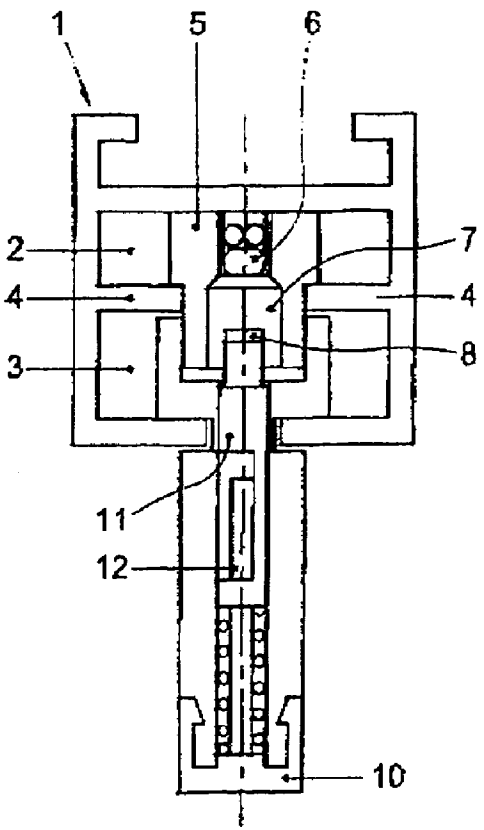
FIG. 2 is a cross-sectional view on the line II—II of the side view of FIG. 1, in which the pivoting arm is not shown.

The exemplary embodiment shown in the figures comprises an apparatus for moving a curtain along a curtain rail 1. The apparatus is provided with a driving body 5 and a coupling body 10, which are movably disposed along respectively a first rail part 2 and a second rail part 3 of the curtain rail 1. Between the first and the second rail part 2, 8, rail section flanges 4 extend. The driving body 5 is connected to a driving cord 6, which may be coupled to a drive not shown. A central body 7 of the driving body 5 extends from the first rail part 2 through a recess between the rail section flanges 4 to the coupling body 10. A side of the central body 7 of the driving body 5 facing the coupling body 10 is provided with a cylindrical hollow space 8. From the coupling body 10 an axially movable locking pin 11 extends in the hollow space 8 of the driving body 5. The end of the locking pin 11 located in the hollow space 8 is rounded, but not beveled such that the locking pin 11 can slide by itself out of the hollow space as a result of a force on the coupling body 10 exerted in the curtain rail longitudinal direction when the driving body 5 is at a standstill. Therefore, the locking pin 11 can effect a reliable coupling between the coupling body 10 and the driving body 5. The position shown is a first coupled position of the locking pin 11, in which it couples the coupling body 10 to the driving body 5. In a second uncoupled position, the locking pin 11 is located outside the hollow space 8 of the driving body 5, so that the coupling body 10 is uncoupled from the driving body 5. This second position is not shown in the figures. The side of the central body 7 facing the coupling body 10 is further provided in the curtain rail longitudinal direction with two grooves 9 having a triangular cross-section. These grooves 9, together with the hollow space 8, form a click section for the locking pin 11.

The coupling body 10 is provided with a pivoting arm 14 which is pivotally connected with the coupling body. The pivoting arm extends from a pivoting point 13 via a recess 12 of the locking pin 11 to an environment of the coupling body 10. The pivoting arm 14 shown in a full and a broken line is in respectively a first and a second position. The size of the recess 12 of the locking pin 11 is such that the locking pin 11 can move from the first to the second position when the pivoting arm 14 is in the first pivoting position. The free end of the pivoting arm 14 is provided with a connecting eye 17, with which the pivoting arm 14 can be connected, for instance, to a curtain or to an operating cord. The coupling body 10 is further provided with a locking pin spring 15 and a pivoting arm spring 16. The locking pin spring and pivoting arm springs 15, 16 exert a spring force directed to the first rail part 2 on respectively the locking pin 11 and the pivoting arm 14.

The exemplary embodiment shown is used as follows.

A curtain is connected to the coupling body 10. Preferably, a part of the curtain is attached to the pivoting arm 14, the pivoting arm spring 16 carrying the weight of this part of the curtain when the pivoting arm 14 is in the first pivoting position. When the coupling body 10 is coupled to the driving body 5, as shown in the figures, the curtain can be moved along the curtain rail 1 by moving the driving cord 6. This will generally be carried out by an electromotor coupled to the cord 6. Not always will electric operation of the curtain be possible or desirable, for instance in case of fire. In that case, the coupling between the curtain and the driving cord 6 can be interrupted manually, so that the user can open and close the curtain by hand. To this end, the pivoting arm 14 is moved to the second pivoting position. The pivoting arm 14 can be operated by means of an operating cord or stick, or by pulling down a part of the curtain attached to the pivoting arm 14 when the curtain is connected to the pivoting arm 14 in the manner described. During pivoting, the pivoting arm 14 moves the locking pin 11 to the second position. As a result, the coupling body 10 is uncoupled from the driving body 5, so that the coupling body 10, together with the curtain, can be moved by hand along the curtain rail 1. After releasing the pivoting arm 14, it is moved back by the pivoting arm spring 16 to the first pivoting position. The locking pin 11 is moved back to the first position as a result of the spring force of the locking pin spring 15.

The coupling of the uncoupled coupling body 10 moved away from the driving body 5 then occurs in the following manner. Initially, the locking pin spring 15 is in the first position. The driving body 5 is moved toward the coupling body 10 by operating the driving cord 6, or vice versa. When both bodies 5, 10 reach each other, a groove wall of a groove 9 of the driving body 5 beveled with respect to the curtain rail longitudinal direction contacts the rounded end of the locking pin 11. When the driving body 5 moves further along the coupling body 10, the locking pin 11 is pushed by the groove wall of the groove 9 from the first position in the direction of the second position. The coupling is completed when the locking pin 11 reaches the hollow space 8 of the driving body 5 and the locking pin spring 15 drives the locking pin 11 into the hollow space 8.

In the exemplary embodiment shown in FIGS. 3–6, a toothed belt 106, which is driven by a driving motor not shown, is provided instead of a driving cord. Attached to the toothed belt 106 are two coupling elements 118 in the manner as described in NL-A-1019467, the subject matter of which is inserted herein by reference. The coupling elements 118 comprise a sleeve 119 which can be slid over the toothed belt 106. By placing a toothed wedge-shaped element 120 in a desired position on the toothed belt 106 and sliding over it the sleeve 119 of a respective coupling element 118, the coupling element 118 is anchored to the toothed belt. Each coupling element 118 is additionally provided with an eye 121 in which a clamping piece 122 can be received. Clampingly received between these clamping pieces 122 is a driving body 105. Just as in the exemplary embodiment shown in FIGS. 1 and 2, the driving body 105 is provided with two run-on surfaces 109, which run-on surfaces 109 together define a substantially triangular section, the apex of that triangular section containing a recess or hollow space 108 into which a locking pin 111 of a coupling body 110 that can be coupled with the driving body 105 falls when the coupling body 110 is coupled with the driving body 105.

The coupling body 110 is provided with the aforementioned locking pin 111 which is pushed up by a locking pin spring 115, so that it, when the coupling body 110 passes the driving body 105, each time lies against the run-on surfaces 109 and, when passing the hollow space 108, is pushed into this hollow space 108. Furthermore, the coupling body 110 is provided with a pivoting arm 114 and a pivoting arm spring 116, which pivoting arm spring 116 pushes up the pivoting arm 114. In the present exemplary embodiment, the locking pin spring 115 is designed as a plastic spring which is integrally formed with the housing 123 surrounding the coupling body 110. The housing 123 also forms a contact surface for the pivoting arm spring 116.

Figure 1:
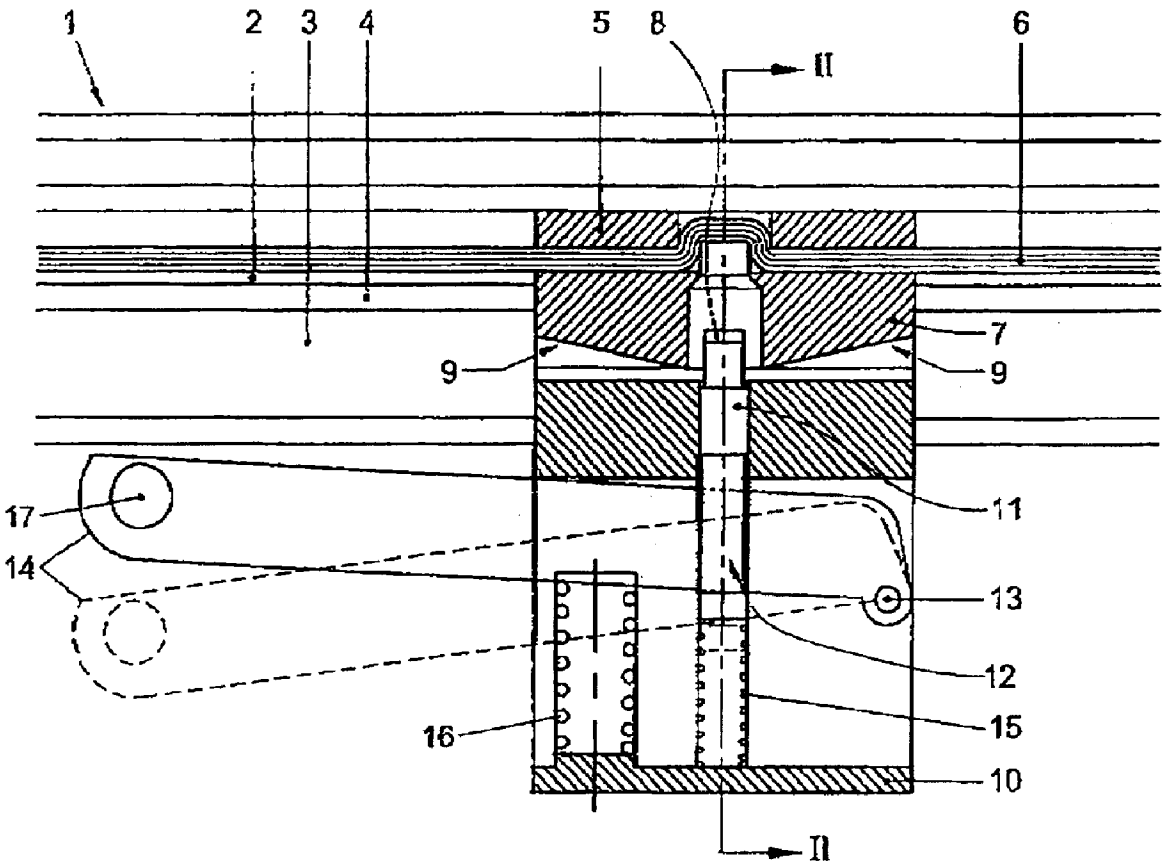
FIG. 1 is a side view of a cut-away exemplary embodiment of the invention.
Figure 3:
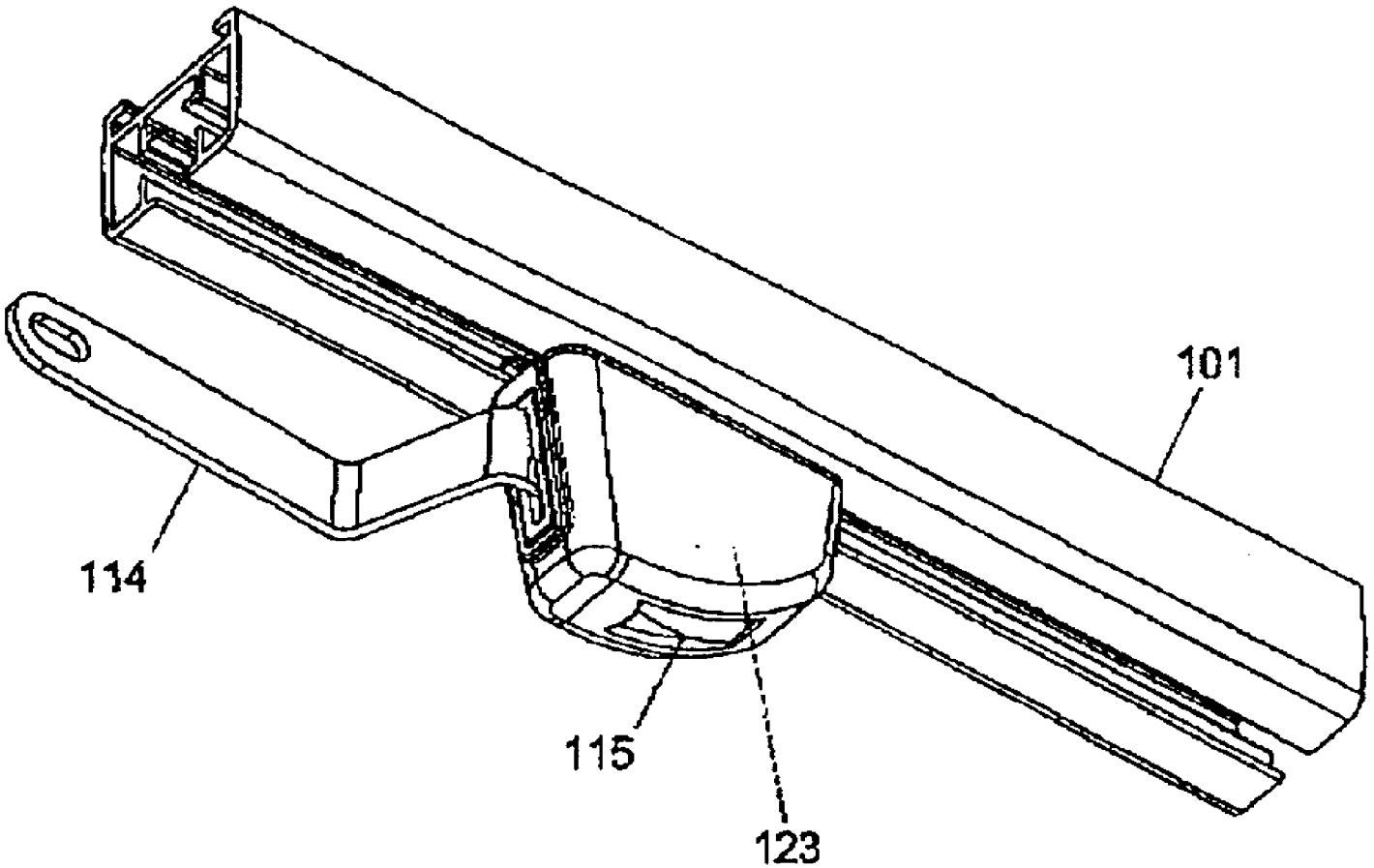
FIG. 3 is a perspective view of a second exemplary embodiment.
Figure 4:
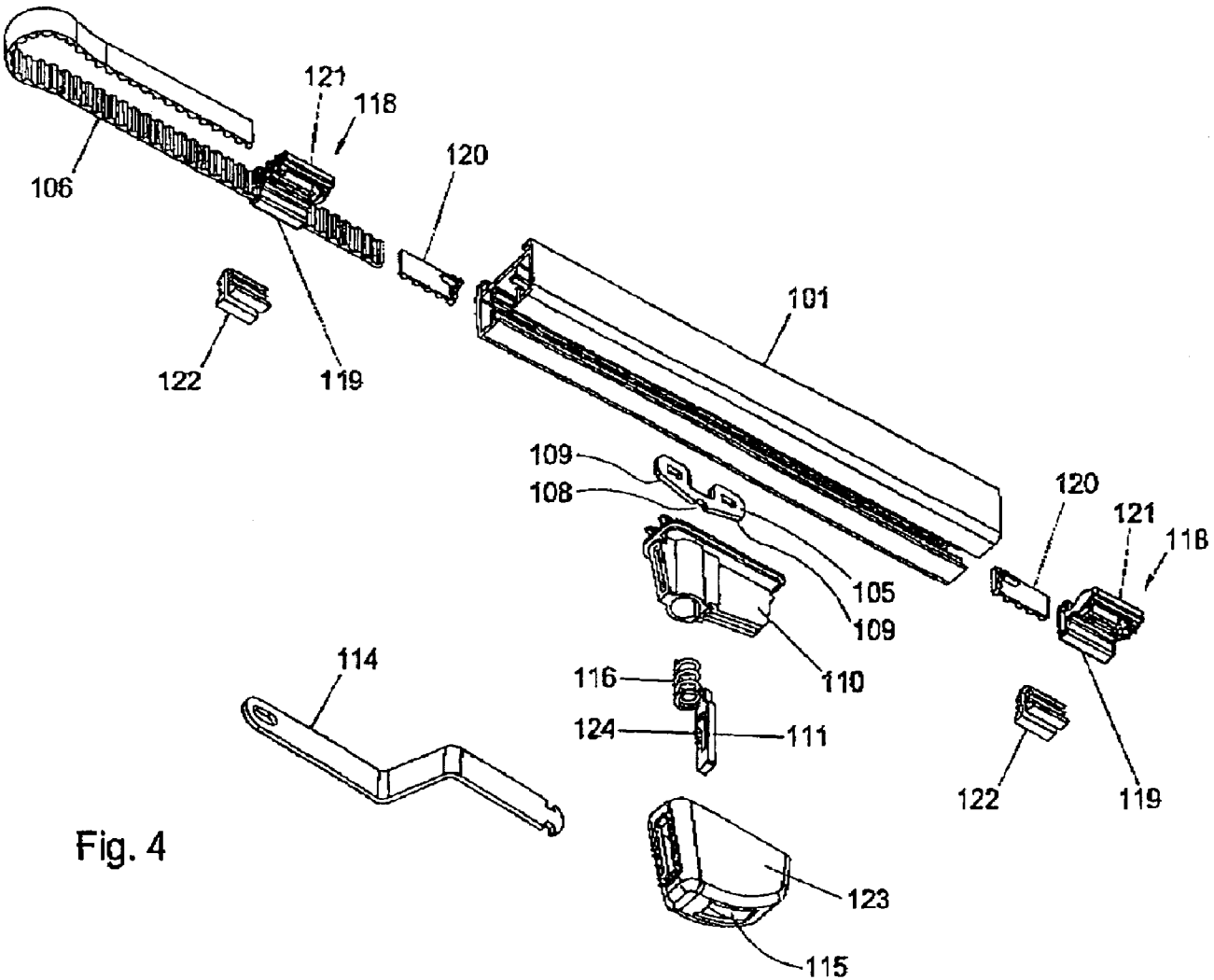
FIG. 4 is a similar perspective view with exploded parts.
Figure 5:
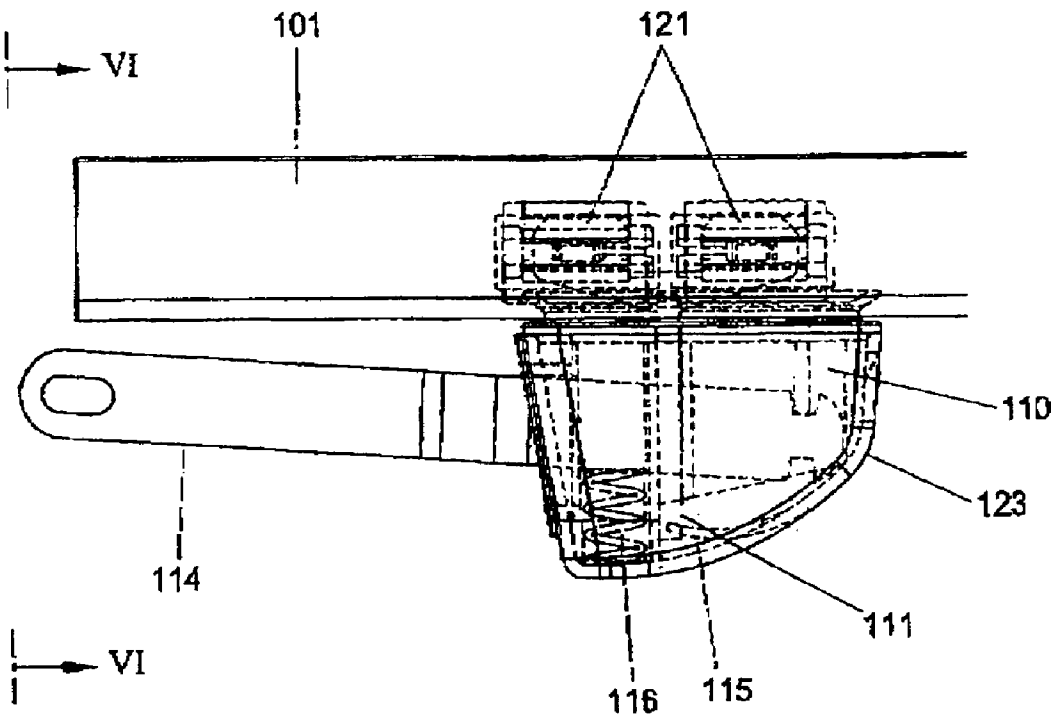
FIG. 5 is a side view of the leader, the component parts in the housing being shown in dotted lines.
Figure 6:
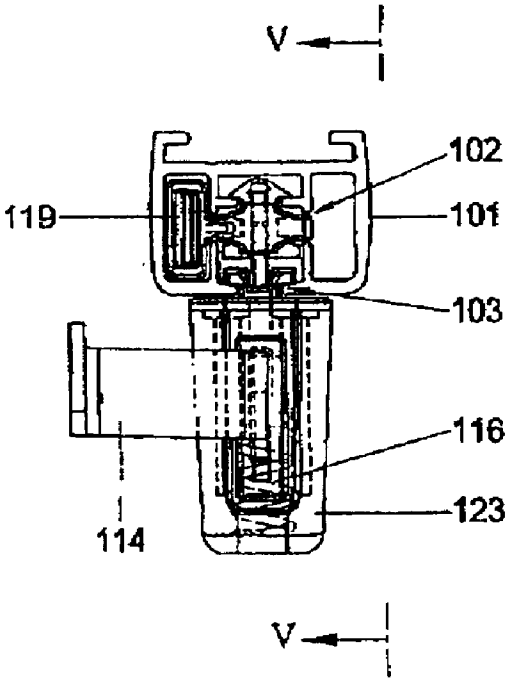
FIG. 6 is a cross-sectional view on the line VI—VI of FIG. 5, the component parts in the housing being shown in dotted lines.

Just as in the exemplary embodiment of FIGS. 1 and 2, an end of the curtain is connected with the coupling body 110, more in particular with the pivoting arm 114. The pivoting arm spring 116 carries the weight of the curtain part suspending from this pivoting arm 114. When the coupling body 110 is coupled to the coupling body 105, the curtain can be moved along the curtain rail 101 by driving the toothed belt 106. The coupling between the coupling element 110 and the toothed belt 106 is interrupted when the user pivots down the pivoting arm 114. Because the pivoting arm 114 is coupled with the locking pin 111 as a result of the pivoting arm 114 extending through a slot 112 in the locking pin 111, the locking pin 111 moves down along with the pivoting arm 114 moving down. As a result, the locking pin 111 is pulled out of the hollow space 108 of the driving body 105, and the coupling body 110 is uncoupled from the driving body 105, so that the curtain can be moved manually through the rails 1 to open and close the curtain. The pivoting arm 114 can be operated by means of a pulling cord or pulling stick. When, subsequently, the driving motor of the toothed belt 106 is put into operation again, and when as a result thereof the driving element 105 passes the coupling element 110, the locking pin 111 will by itself reach the recess 108 via the run-on surfaces 109 and be pushed into it by the locking pin spring 115. At that moment, the coupling between the coupling element 110 and the driving body 105 is restored again, so that the curtain can be opened and closed automatically again by means of the toothed belt 106.

It may be clear that the invention is not limited to the exemplary embodiments described, but that various modifications are possible within the scope of the invention.

Besides the cord 6 or the toothed belt 106 shown, the above driving means may also comprise, for instance, a chain.

What is claimed is:

1. An apparatus for moving a curtain along a rail comprising:

a) a rail having first and second tracks and first and second ends;

b) a curtain attached to the rail;

c) driving means movable along the rail first track;

d) coupling means movable along the rail second track, the coupling means operable to couple the curtain to the driving means;

e) uncoupling means operable to uncouple coupling means from driving means so that the curtain is movable along the rail independently of the driving means, the uncoupling means configured to operate independently of a force exerted on the curtain to move the curtain towards either the rail first end or the rail second end.

2. An apparatus according to claim 1, characterized in that the uncoupling means (14; 114) are connected with the curtain, such that the uncoupling means are operated when a force directed downward, substantially perpendicularly to the curtain rail longitudinal direction, is exerted on the curtain, a pulling cord or pulling stick.

3. An apparatus according to claim 1, characterized in that the driving means (5, 6; 105, 106) are provided with a driving body (5; 105), the coupling means (10, 11; 110,111) comprising a coupling body (10; 110) with an engaging element (11; 111), which engaging element (11; 111), in a first position, couples the coupling body (10; 110) to the driving body (5; 105), the engaging element (11; 111) moving from the first to a second position when operating the uncoupling means (14; 114).

4. An apparatus according to claim 3, characterized in that the engaging element (11; 111), in the first position, engages the driving body (5; 105) such that the driving body (5; 105) exerts on the engaging element (11; 111) a force directed substantially in the curtain rail longitudinal direction when a force is exerted on the curtain substantially in a curtain longitudinal direction.

5. An apparatus according to claim 3, characterized in that the driving body (5; 105) and the coupling body (10; 110) are movably disposed along respectively a first rail part and a second rail part (2, 3; 102, 103).

6. An apparatus according to claim 3, characterized in that the coupling body (10; 110) is provided with spring means (15; 115) which exert a spring force on the engaging element (11; 111), which spring force is directed from the second to the first position of the engaging element (11; 111).

7. An apparatus according to claim 6, characterized in that the driving body (5; 105) is provided with coupling means (9; 109) for coupling an uncoupled coupling body (10; 110) moved away from the driving body, which coupling means (9; 109), in use, exert a coupling force on the engaging element (11; 111) when the driving body and the coupling body (5 and 10; 105 and 110) are moved along each other, which coupling force is directed against the spring force of the spring means (15).

8. An apparatus according to claim 3, characterized in that the engaging element comprises a locking pin (11; 111) which, in the first position, extends from the coupling body (10; 110) into an opposite hollow space (8; 108) of the driving body (5; 105), which locking pin (11; 111), in the second position, is outside the driving body (5), such that the coupling body (10; 110) is uncoupled from the driving body (11; 111).

9. An apparatus according to claim 8, characterized in that the locking pin (11; 111) extends substantially at right angles to the longitudinal direction of the curtain rail (1; 101), the coupling means comprising a click section (9; 109), which click section, in use, drops the locking pin (11; 111) into a hollow space in said driving body (8; 108) when the coupling body and the driving body are moved along each other from a position moved away from each other.

10. An apparatus according to claim 3, characterized in that the uncoupling means comprise a pivoting arm (14; 114) which is pivotally connected with the coupling body (10; 110), the pivoting arm (14; 114) being coupled to the engaging element (11; 111) such that, in use, the enraging element (11; 111) moves from the first to the second position when the pivoting arm pivot from a first to a second pivoting position.

11. An apparatus according to claim 10, characterized in that the pivoting arm (14; 114) is connected with the curtain, such that the pivoting arm moves to the second pivoting position when a force directed downward, substantially perpendicularly to the curtain rail longitudinal direction, is exerted on the curtain.

12. An apparatus according to claim 10, characterized in that the uncoupling means (12, 13, 14; 114) are provided wit pivoting arm spring means (16; 116) which exert a spring force on the pivoting arm (14; 114), which spring force is directed from the second to the first pivoting position of the pivoting arm (14; 114).

13. An apparatus according to claim 10, characterized in that the pivoting arm (14; 114) is coupled to the engaging element (11; 111) with such play that the engaging element (11; 111) is movable from the first to the second position when the pivoting arm is in the first pivoting position.

* * * * *